United States Patent [19]

Terry

[11] Patent Number: 4,484,629

[45] Date of Patent: Nov. 27, 1984

[54] MOVABLE OXIDIZER INJECTION POINT FOR PRODUCTION OF COAL IN SITU

[75] Inventor: Ruel C. Terry, Denver, Colo.

[73] Assignee: In Situ Technology, Inc., Golden, Colo.

[21] Appl. No.: 426,170

[22] Filed: Sep. 28, 1982

[51] Int. Cl.[3] ..... E21B 43/247

[52] U.S. Cl. ..... 166/259; 166/50; 166/263

[58] Field of Search ..... 166/50, 256–263; 299/2; 48/DIG. 6

[56] References Cited

U.S. PATENT DOCUMENTS

| | | | |
|---|---|---|---|
| 2,788,956 | 4/1957 | Pevere et al. | 166/259 |
| 3,017,168 | 1/1962 | Carr | 299/2 |
| 3,506,309 | 4/1970 | von Hippel | 299/2 |
| 3,563,606 | 2/1971 | Sears | 299/2 |
| 4,010,801 | 3/1977 | Terry | 166/261 |
| 4,057,293 | 11/1977 | Garrett | 166/263 X |
| 4,087,130 | 5/1978 | Garrett | 299/2 |
| 4,185,692 | 1/1980 | Terry | 166/261 X |
| 4,230,181 | 10/1980 | Pennington | 299/2 X |
| 4,334,579 | 6/1982 | Gregg | 166/256 |
| 4,356,866 | 11/1982 | Savins | 166/261 |
| 4,436,153 | 3/1984 | Carlson | 166/259 X |

*Primary Examiner*—George A. Suchfield
*Attorney, Agent, or Firm*—Ruel C. Terry

[57] ABSTRACT

After a linkage channel is established through an underground coal seam connecting two vertical wells, a tubing bender/straightener is positioned in a first well aligned with the linkage channel. Oxidizer injection tubing is inserted from the wellhead into the tubing bender/straightener. The tubing is forced through the tubing bender/straightener and on into the linkage channel. The coal is ignited and the fire sustained by continuous injection of oxidizer through the tubing, creating a reaction zone separated from the first well with products of reaction recovered through the second well.

3 Claims, 1 Drawing Figure

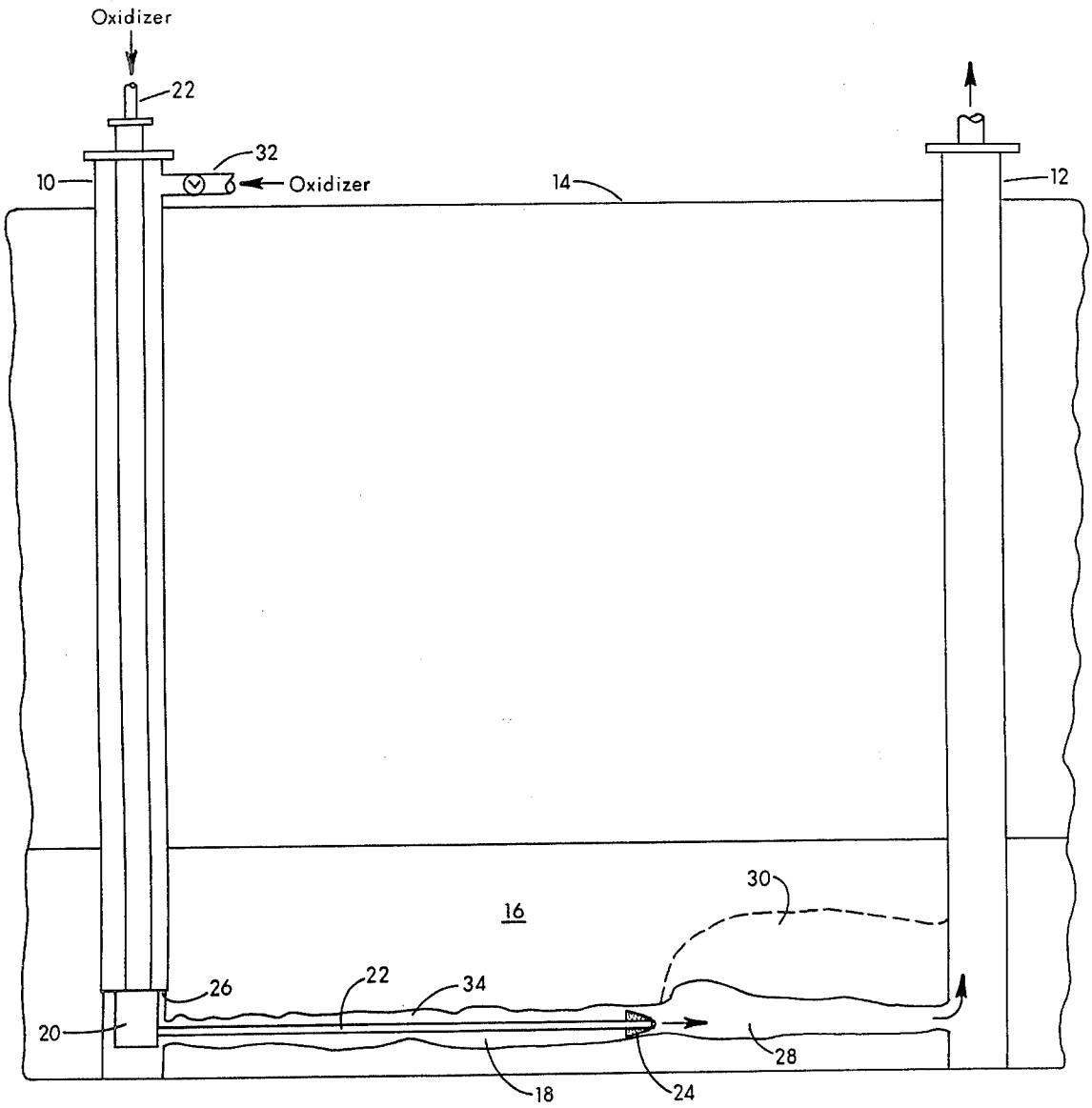
Oxidizer
22
32
10
Oxidizer
14
12
16
30
26
22
34
20
28
18
24

MOVABLE OXIDIZER INJECTION POINT FOR PRODUCTION OF COAL IN SITU

BACKGROUND OF THE INVENTION

This invention relates to the production of coal in situ using pairs of vertical wells linked together through the coal seam. More particularly the invention teaches the use of a movable oxidizer injection point so that the underground reaction zone can be positioned away from the oxidizer injection well.

This invention extends the teachings of my U.S. Pat. No. 4,185,692, which is incorporated herein by reference. In reference patent methods were taught of accomplishing underground linkage using one or more blind hole burns.

One of the significant problems encountered in full scale field tests of producing coal in situ is that of the high temperatures occurring around the injection well. Generally the injection well is bottomed in the lower portion of the coal seam, with the linkage to the production well also positioned at or near the bottom of the seam. Oxidizer is injected at this point to sustain gasification. Initially only a portion of the oxidizer is consumed in the linkage, with the balance used to consume coal around the injection well. In the early stages of production a generally cylindrical cavity is burned the full depth of the seam from the bottom to the top of the seam before any appreciable cavity growth occurs in the linkage channel. Radius of this cylinder is generally in the order of 15 feet and the temperature of the burn is high enough to cause substantial damage to the lower part of the casing—often burning away the casing thus exposed. The oxidizer injection point that began at the bottom of the seam is thus changed at the top of the seam, generally creating a flame override situation with respect to the linkage channel.

Thus it is apparent that it is highly desirable to have an oxidizer injection point in the linkage channel sufficiently removed from the injection well to prevent burning of a cavity around the injection well casing. It is an object of the present invention to teach the use of a movable oxidizer injection point.

Some work in this general area has been accomplished by Lawrence Livermore National Laboratory (LLNL) in field tests recently conducted in the State of Washington. These tests involved drilling a horizontal well at the bottom of a 20′ seam at the high wall of a strip mine. This well was completed as an injection well which was intercepted at its extremity by a vertical well through the overburden. A reaction zone was established using the vertical well as the production well. Coal was gasified for a period of several days, injection was terminated and the injection tubing was shortened. A second reaction zone was then established apart from the original burned out cavity. LLNL has identified this procedure as the controlled retractable injection point. In this procedure during the first burn, casing damage is sustained by the production well in addition to damage to the original end of the injection tubing. Since the injection tubing extremity is considered expendable, no particular damage occurs to the injection well.

SUMMARY OF THE INVENTION

A pair of vertical wells, appropiately spaced apart, are drilled into an underground coal seam. The wells are linked together near the bottom of the seam. A tubing bender/straightener is positioned in the injection well and aligned with the linkage channel. Injection tubing is inserted through the wellhead and forced through the tubing bender/straightener and into the linkage channel. The extremity of the injection tubing is positioned at a point sufficiently remote from the injection well to avoid damage to the casing when gasification is underway. The coal is ignited at the end of the injection tubing and gasification is sustained by continuous injection of an oxidizer. Products of reaction are recovered through the linkage channel and through the production well to surface facilities.

BRIEF DESCRIPTION OF THE DRAWING

The single FIGURE of the drawing is a vertical diagrammatic section taken through a section of the earth which shows a pair of wells linked together through the coal and equipped for the methods of the invention.

DESCRIPTION OF THE PREFERRED EMBODIMENT

A pair of vertical wells 10 and 12 are drilled from the surface of the earth 14 into an underground coal seam 16. The wells are spaced apart an appropiate distance, for example 300 feet. The wells are linked together by a channel 18 through the coal seam. The linkage channel can be accomplished by any convenient method, but preferably as taught in U.S. Pat. No. 4,185,692 of the present inventor. The wells are hermetically sealed by the installation of appropiate casing, with wellhead fittings commonly used in production of coal in situ.

A tubing bender/straightener 20 is then positioned at the bottom of the injection well and aligned with the linkage channel. The tubing bender/straightener can be of any convenient configuration capable of making a 90 degree bend of the tubing 22 within the confines of the wellbore. Preferably the tubing bender/straightener is constructed with a housing describing a 90 degree arc of the bending circle with a short section that restrains and straightens the tubing after being subjected to bending. Preferably the tubing bender/straightener contains a thruster pulley in friction contact with the tubing to facilitate the force required to accomplish bending, straightening and movement of the tubing into the linkage channel. Preferably the thruster pulley is powered with a hydraulic motor capable of forward and reverse drive. To facilitate movement of the tubing in the linkage channel, a deflector 24 is affixed to the end of the tubing after the tubing clears the tubing bender/straightener. The deflector can be of any convenient configuration that permits the tubing to ride over minor obstacles encountered in the linkage channel. Preferably the deflector is constructed in the shape of a cone with a hole through its axis of a size that permits an interference fit onto the injection tubing. In this configuration the base of the deflector is force fitted over the injection tubing to a point where the extremity of the tubing is flush with the smallest diameter portion of the cone. The deflector can be constructed with any convenient material, but preferably is made of ceramic material.

In positioning the tubing bender/straightener aligned with the linkage channel, it is preferred that tubing 22 be inserted at the surface of the earth, with sufficient tubing to affix the deflector prior to lowering the tubing bender/straightener—with its power connections—into position. Once in position the tubing bender/straightener should be anchored 26 prior to activation. Such anchoring may be done by any convenient method, for example by suitable attachment to the bottom of the casing or by setting with cement.

Once the tubing bender/straightener is anchored, the mechanism is activated and injection tubing 22 is directed into the linkage channel at an appropriate point. Preferably the tubing end is positioned near the midpoint of the linkage channel, for example a point approximately 140 feet from the injection well. With the injection tubing positioned, the coal is ignited and oxidizer injection begun to sustain gasification. In this mode the reaction zone 28, sometimes called a georeactor, is established at a safe distance from the injection well and the production well. Once the georeactor is fully established 30, injection of oxidizer is terminated, in the injection tubing 22, followed by injection of oxidizer through the injection well casing 32 and into the georeactor. In this manner gasification continues as a forward burn in the georeactor, but the oxidizer injection rate can be increased substantially.

If desired the oxidizer injection tubing can be partially retracted, for example to a point 34 about 60 feet from the injection well. The repositioned injection tubing can be left idle until it is desirable to establish a georeactor nearer the injection well. Establishing the second georeactor will become desirable when the initial georeactor grows in size to the point where the burn is approaching the wellbore of the production well. By establishing the second georeactor injected oxidizer will be consumed before reaching the initial georeactor, thus terminating reactions in the initial georeactor. With wider well spacings it is apparent that a series of georeactors can be established in sequence between the pair of wells. Further it is apparent that georeactor growth can be reversed by swapping roles of the pair of wells, that is, converting the production well into an injection well and the original injection well into a production well.

Thus it may be seen that by establishing a movable oxidizer injection point, georeactors can be positioned to avoid destruction of well casing, that multiple georeactors can be established between pairs of wells, and that georeactor growth movement can be adjusted to or from a given well. While the present invention has been described with a certain degree of particularlity, it is understood that the present disclosure has been made by way of example and that changes in detail of structure may be made without departing from the spirit thereof.

What is claimed is:

1. A method of gasifying coal in situ wherein a first vertical well and a spaced apart second vertical well have been drilled from the surface of the earth into an underground coal seam, and wherein the two vertical wells have been linked together with a channel through the coal seam, comprising the steps of positioning a tubing bender/straightener aligned with the said channel in the first well, inserting oxidizer injection tubing through the wellhead of the first well, through the tubing bender/-straightener and into the said linkage channel, wherein the extremity of the oxidizer injection tubing within the said channel is located at a point removed from the first well, igniting the coal in the linkage channel adjacent to the extremity of the oxidizer injection tubing, injecting oxidizer into the linkage channel through the oxidizer injection tubing with the resultant establishment of a georeactor in the linkage channel adjacent to the second well, producing the gasified coal through the second well, then terminating injection of oxidizer through the oxidizer injection tubing then, injecting oxidizer into the georeactor through the casing of the first well, and producing gasified coal through the second well.

2. The method of claim 1 wherein the extremity of the oxidizer injection tubing within the linkage channel is retracted to a point between the operating georeactor and the wellbore of the first well.

3. The method of claim 1 wherein a deflector is attached to the extremity of the oxidizer injection tubing after the said tubing has passed out of the tubing bender/straightener and before the tubing is further inserted into the linkage channel.

* * * * *